US011304533B1

(12) United States Patent
Horton

(10) Patent No.: US 11,304,533 B1
(45) Date of Patent: Apr. 19, 2022

(54) PORTABLE BEACH STOOL

(71) Applicant: Rickey Horton, Lancaster, SC (US)

(72) Inventor: Rickey Horton, Lancaster, SC (US)

( * ) Notice: Subject to any disclaimer, the term of this patent is extended or adjusted under 35 U.S.C. 154(b) by 0 days.

(21) Appl. No.: 17/158,133

(22) Filed: Jan. 26, 2021

(51) Int. Cl.
*A47C 9/10* (2006.01)
*A47C 4/28* (2006.01)
*A47C 7/00* (2006.01)

(52) U.S. Cl.
CPC ..... *A47C 7/004* (2013.01); *A47C 9/10* (2013.01)

(58) Field of Classification Search
CPC ..... A47C 9/10
USPC ..... 297/4, 45
See application file for complete search history.

(56) References Cited

U.S. PATENT DOCUMENTS 731,437 A * 6/1903 Czermak et al. ..... A45B 5/00 248/155.1
1,111,586 A * 9/1914 Hurlbert ..... A47C 9/00 297/461
1,218,357 A * 3/1917 Bauer ..... A47B 3/12 108/158
1,379,129 A * 5/1921 Sejnoha ..... A47C 9/10 108/166
1,709,200 A * 4/1929 Westbrook ..... A47C 9/04 297/4 X
1,956,956 A * 5/1934 Leibo ..... A47C 9/10 297/378.1
2,064,215 A * 12/1936 Noe ..... A47C 9/10 248/155
2,137,799 A * 11/1938 Brandenburg ..... A47C 9/105 108/116
2,258,940 A * 10/1941 Stanton ..... A47C 9/10 108/115
2,625,985 A * 1/1953 Morgan ..... A47C 9/10 248/121
2,690,211 A * 9/1954 Wentz ..... A45B 5/00 248/155.1
2,720,249 A * 10/1955 Peterson ..... A47C 9/10 108/141
2,800,164 A * 7/1957 Chambers ..... A45B 5/00 248/155.1
2,877,828 A * 3/1959 Barnette, Jr. ..... A47C 9/10 248/533
3,058,711 A * 10/1962 Ellis ..... A47C 9/10 248/155.2
3,165,077 A * 1/1965 Olson ..... A47C 9/10 108/33
3,177,825 A * 4/1965 Jones ..... A45B 5/00 108/128
3,283,733 A * 11/1966 Boerma ..... A45F 3/44 108/159
3,467,033 A * 9/1969 Remer ..... A47C 9/10 108/150

(Continued)

*Primary Examiner* — Rodney B White
(74) *Attorney, Agent, or Firm* — Kyle A. Fletcher, Esq.

(57) ABSTRACT

The portable beach stool comprises a leg and a seat. The portable beach stool may be adapted for a user to sit upon while at a beach. An auger at the bottom of the leg may be configured to bore into sand such that the leg may stand upright in the sand. The seat may detachably couple to a plurality of support struts located on the top half of the leg such that the seat is retained in a horizontal orientation above the leg. The plurality of support struts may collapse for transportation and storage when the seat is detached.

17 Claims, 6 Drawing Sheets

(56) References Cited

U.S. PATENT DOCUMENTS 4,085,686 A * 4/1978 Turner ..... A01K 97/06 108/25
4,098,478 A 7/1978 Spitzke
4,130,294 A * 12/1978 Walker ..... A63C 11/001 248/155.1
4,318,567 A * 3/1982 Guthier ..... A47C 15/004 135/16
4,461,220 A * 7/1984 Wetzel ..... A47B 37/04 108/30
4,832,304 A * 5/1989 Morgulis ..... A01K 97/10 248/533
4,848,712 A * 7/1989 Russell ..... A47C 9/10 248/155.2
5,046,699 A * 9/1991 Perreault et al. ..... A45F 3/44 248/533
5,110,184 A 5/1992 Stein
5,122,014 A * 6/1992 Genfan ..... E02D 5/801 248/156
5,188,422 A * 2/1993 Montgomery ..... A47C 9/027 108/150
5,293,889 A * 3/1994 Hall ..... A45B 3/00 135/16
5,358,209 A * 10/1994 Ward ..... E04H 12/2223 248/530
5,470,038 A * 11/1995 Clark ..... A45B 5/00 248/156
5,673,966 A * 10/1997 Morton, Jr. ..... A47C 9/10 297/4 X
5,975,635 A * 11/1999 Parpala ..... A47C 9/10 297/188.08
6,176,545 B1 * 1/2001 Hambleton ..... A47C 9/10 297/4 X
6,199,569 B1 * 3/2001 Gibson ..... E04H 12/2223 135/16
6,216,382 B1 * 4/2001 Lindaman ..... A01M 31/06 43/2
6,321,861 B1 * 11/2001 Leichter ..... E21B 10/44 175/323
6,715,503 B2 4/2004 Brooks, III
6,893,097 B1 * 5/2005 Ebensperger ..... A47C 9/10 297/4 X
6,997,511 B2 * 2/2006 Marchand ..... A47C 9/025 297/313
7,285,056 B1 * 10/2007 Whitt ..... A63B 69/3608 473/266
7,740,308 B2 * 6/2010 Mishly ..... A47C 4/42 297/17
8,191,561 B2 * 6/2012 Brooks, III ..... E04H 12/2223 135/16
8,663,039 B2 3/2014 Chiu
9,301,621 B2 * 4/2016 Barstad ..... A47C 4/022
9,554,630 B1 * 1/2017 Patel ..... A45F 3/44
10,077,893 B1 * 9/2018 Abraham ..... A45F 3/44
10,687,628 B1 6/2020 Kite
11,064,795 B2 * 7/2021 Bland ..... A47C 9/02
2014/0327289 A1 * 11/2014 Portis ..... A47C 4/28 297/452.1
2021/0227983 A1 * 7/2021 Walker ..... A47C 7/628

* cited by examiner

PORTABLE BEACH STOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of recreational beach equipment and portable seating, more specifically, a portable beach stool.

SUMMARY OF INVENTION

The portable beach stool comprises a leg and a seat. The portable beach stool may be adapted for a user to sit upon while at a beach. An auger at the bottom of the leg may be configured to bore into sand such that the leg may stand upright in the sand. The seat may detachably couple to a plurality of support struts located on the top half of the leg such that the seat is retained in a horizontal orientation above the leg. The plurality of support struts may collapse for transportation and storage when the seat is detached.

An object of the invention is to provide a portable seat for use at a beach.

Another object of the invention is to provide a leg that may be inserted into sand by rotating the leg such that an auger located at the bottom of the leg bores into the sand.

A further object of the invention is to provide a plurality of support struts for coupling the seat to the center leg.

Yet another object of the invention is to provide a seat that detachably couples to the plurality of support struts to form a horizontal seating surface.

These together with additional objects, features and advantages of the portable beach stool will be readily apparent to those of ordinary skill in the art upon reading the following detailed description of the presently preferred, but nonetheless illustrative, embodiments when taken in conjunction with the accompanying drawings.

In this respect, before explaining the current embodiments of the portable beach stool in detail, it is to be understood that the portable beach stool is not limited in its applications to the details of construction and arrangements of the components set forth in the following description or illustration. Those skilled in the art will appreciate that the concept of the disclosure may be readily utilized as a basis for the design of other structures, methods, and systems for carrying out the several purposes of the portable beach stool.

It is therefore important that the claims be regarded as including such equivalent construction insofar as they do not depart from the spirit and scope of the portable beach stool. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
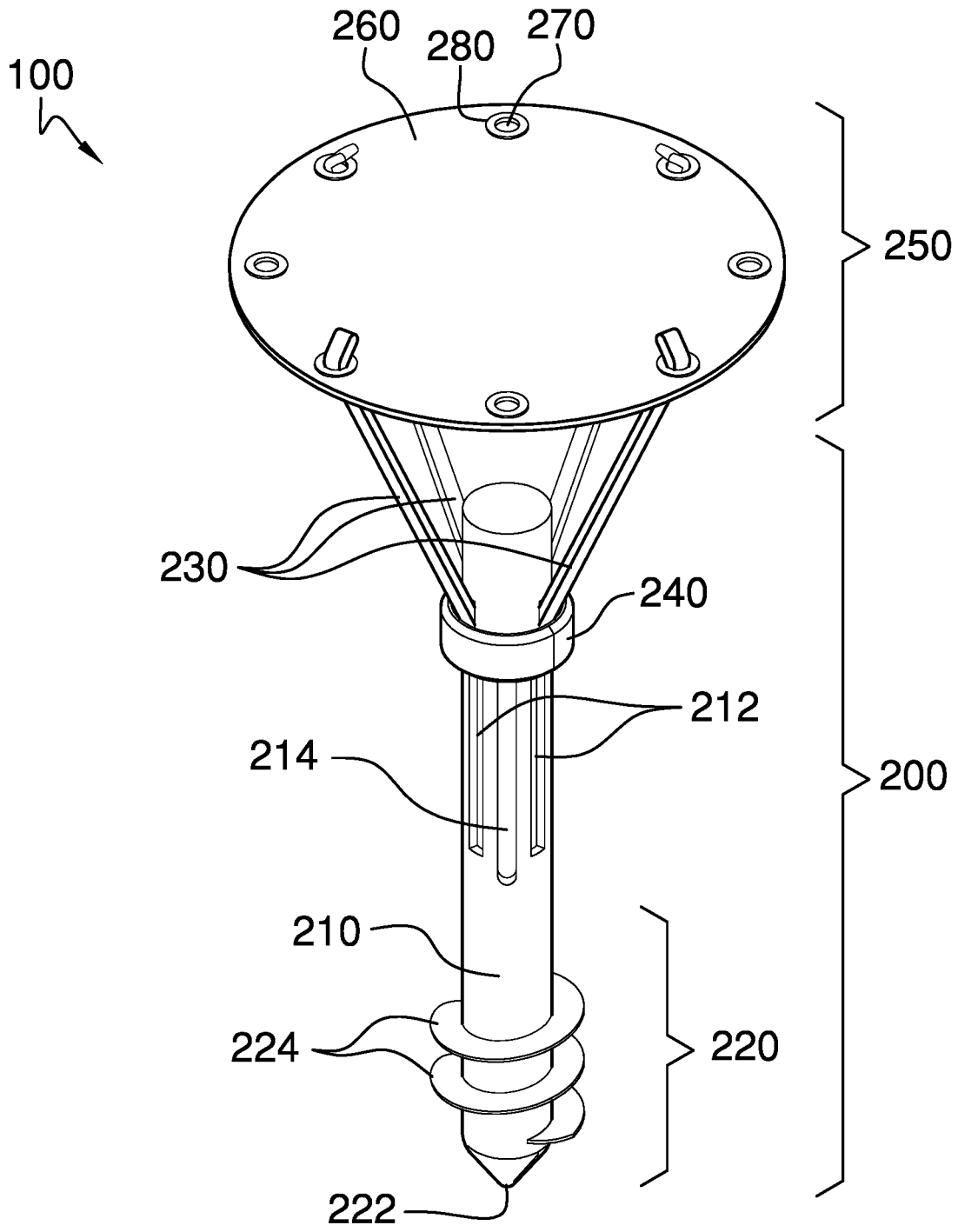
FIG. 1 is an isometric view of an embodiment of the disclosure.
Figure 2:
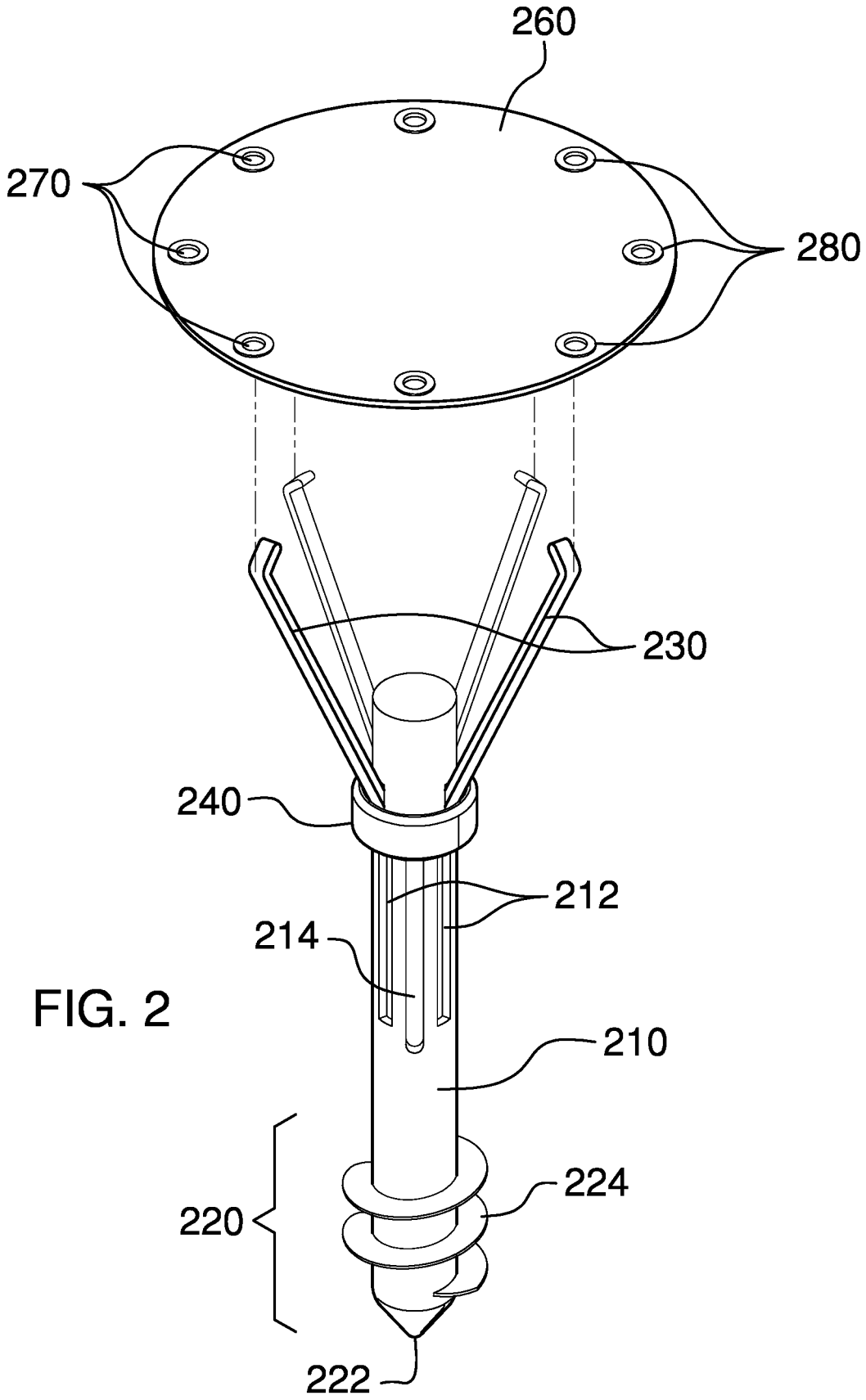
FIG. 2 is an exploded view of an embodiment of the disclosure.
Figure 3:
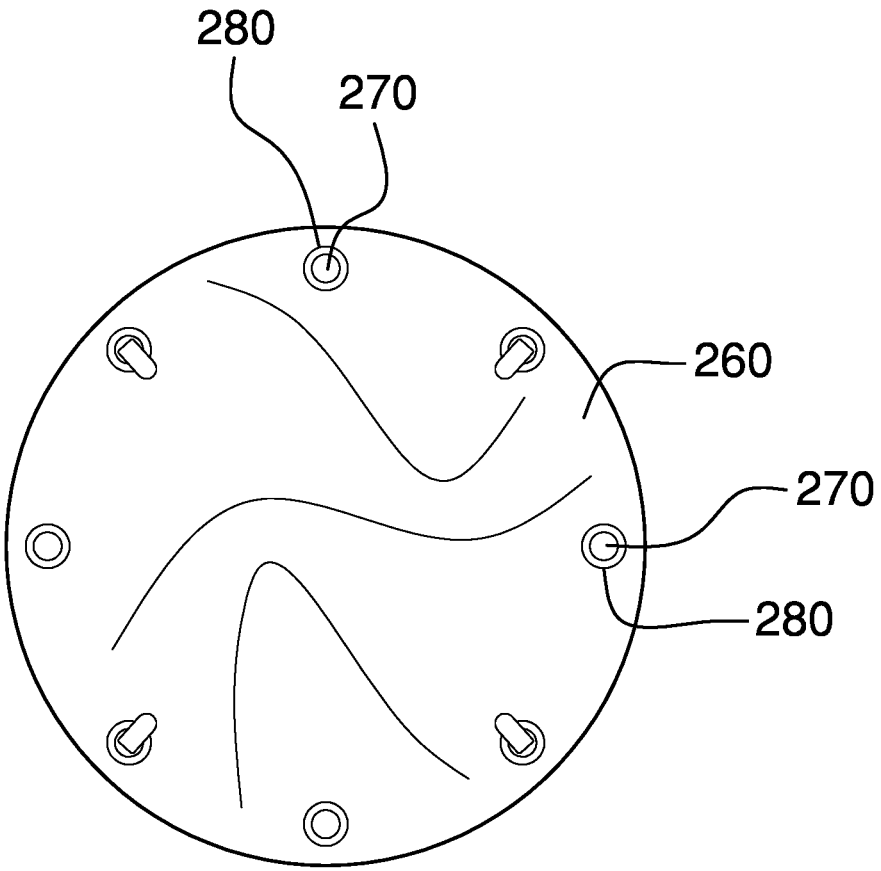
FIG. 3 is a top view of an embodiment of the disclosure.
Figure 4:
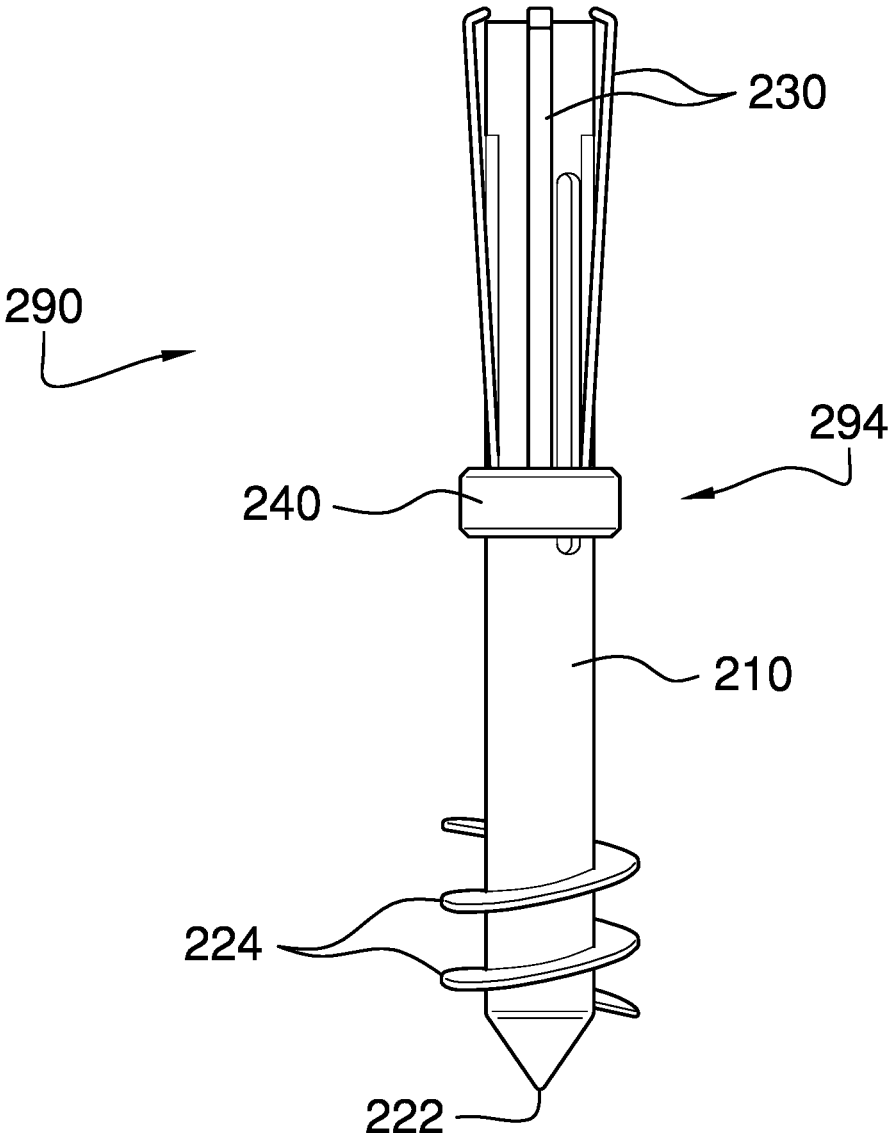
FIG. 4 is a side view of an embodiment of the disclosure illustrating the collapsed configuration.
Figure 5:
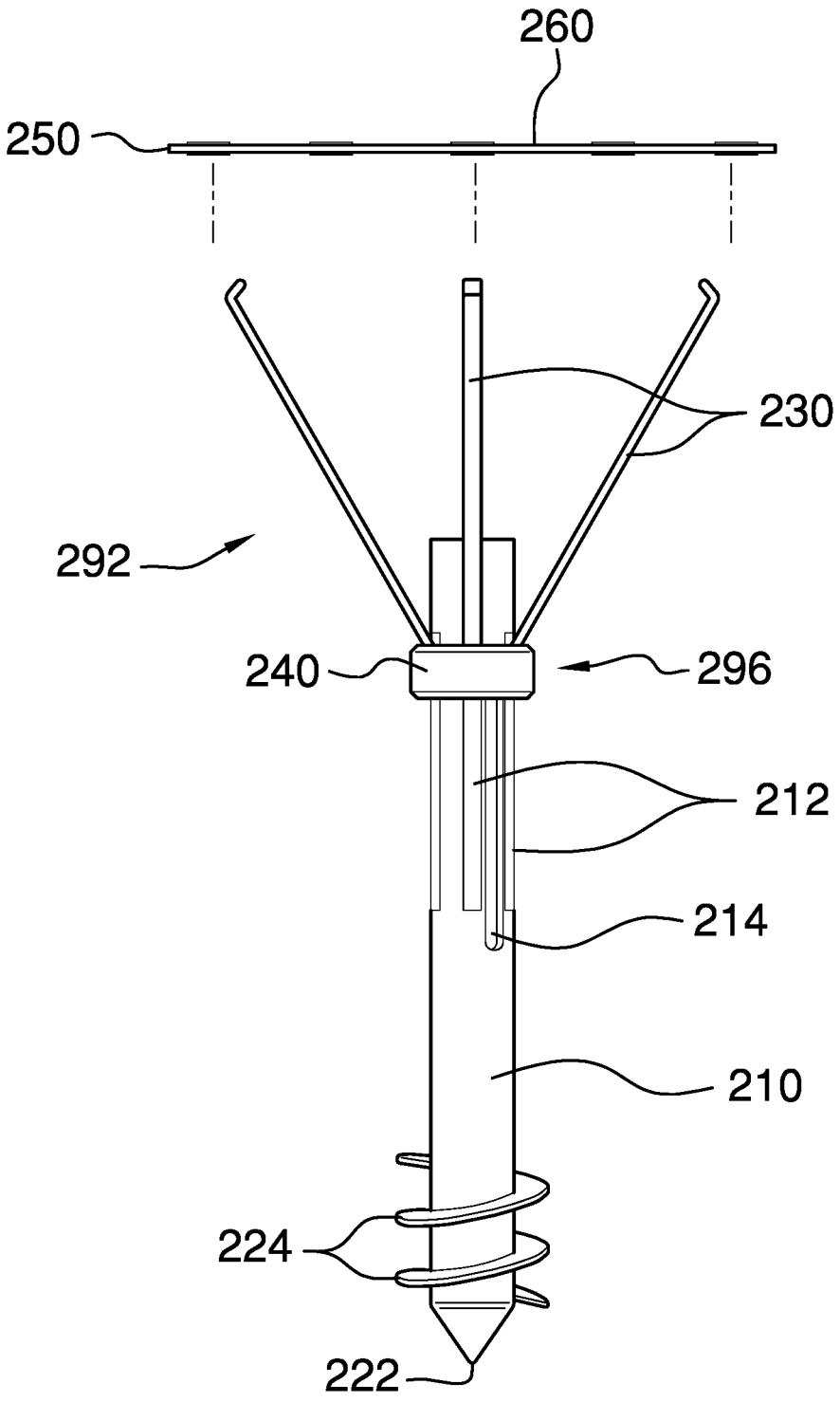
FIG. 5 is a side view of an embodiment of the disclosure illustrating the deployed configuration.
Figure 6:
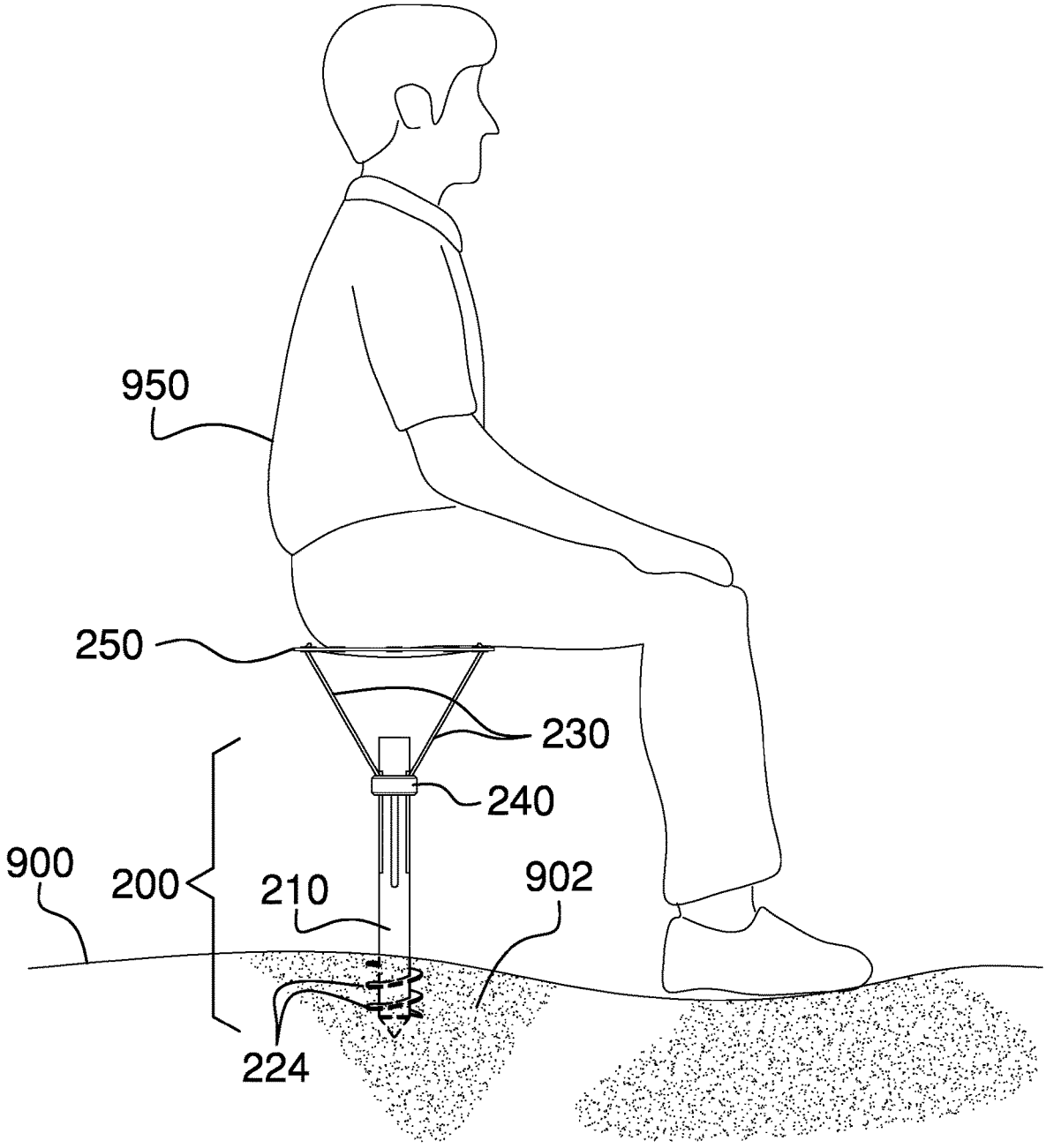
FIG. 6 is an in-use view of an embodiment of the disclosure.

Detailed reference will now be made to a first potential embodiment of the disclosure, which is illustrated in FIGS. 1 through 6.

The portable beach stool 100 (hereinafter invention) comprises a leg 200 and a seat 250. The invention 100 may be adapted for a user 950 to sit upon while at a beach 900. An auger 220 at the bottom of the leg 200 may be configured to bore into sand 902 such that the leg 200 may stand upright in the sand 902. The seat 250 may detachably couple to a plurality of support struts 230 located at on the top half of the leg 200 such that the seat 250 is retained in a horizontal orientation above the leg 200. The plurality of support struts 230 may collapse for transportation and storage when the seat 250 is detached.

The leg 200 may comprise a center post 210, the auger 220, the plurality of support struts 230, and a strut ring 240. The center post 210 may be vertically-oriented pillar. The auger 220 may comprise the lower end of the center post 210. The plurality of support struts 230 may be disposed around the sides of the center post 210 at the top of the center post 210.

A plurality of strut channels 212 may be vertically-oriented grooves located on the side of the center post 210. The bottom of the plurality of strut channels 212 may align with a vertical midpoint of the center post 210. The plurality of strut channels 212 may extend upwards without reaching the top of the center post 210. There may be a one-to-one correspondence between the plurality of support struts 230 and the plurality of strut channels 212.

One or more ring guide slots 214 may be one or more vertically oriented grooves located on the side of the center post 210. The one or more ring guide slots 214 may guide the vertical movements of the strut ring 240. As a non-limiting example, one or more ring guide tabs located on the inside surface of the strut ring 240 may ride in the one or more ring guide slots 214 to prevent the strut ring 240 from twisting.

The auger 220 may comprise a tip 222 and a thread 224. The tip 222 may be a pointed bottom of the center post 210. The thread 224 may be a helical ramp that converts rotational motion of the center post 210 into vertical movement of the center post 210.

The plurality of support struts 230 may be armatures that detachably couple the seat 250 to the center post 210. The bottom of the plurality of support struts 230 may be hingedly coupled to the inside surface of the strut ring 240. The top of the plurality of support struts 230 may detachably couple to the seat 250 via a plurality of strut apertures 270. The top of the plurality of support struts 230 may be shaped to retain the seat 250 at the height of the top of the plurality of support struts 230. Many possibly shapes are possible top retain the seat 250 in place on the plurality of support struts 230. The shape of the top of the plurality of support struts 230 may prevent the seat 250 from being forced down and may also prevent the seat 250 from being lifted up unless the plurality of support struts 230 are repositioned.

The strut ring 240 may encircle the center post 210 such that the strut ring 240 may slide vertically on the center post 210 between a lower position 294 and an upper position 296. in the lower position 294, the strut ring 240 may pull the plurality of support struts 230 down and may pull the plurality of support struts 230 into the plurality of strut channels 212. In some embodiments, the strut ring 240 may lock when in the lower position 294, the upper position 296, or both. As non-limiting examples, the strut ring 240 may comprise a twist lock mechanism, a spring-loaded release mechanism, friction lock mechanism, or combinations thereof.

The plurality of support struts 230 may be moved between a collapsed configuration 290 and a deployed configuration 292 by raising and lowering the strut ring 240. In the collapsed configuration 290, the strut ring 240 may be moved to the lower position 294 and the plurality of support struts 230 may be pressed into the plurality of strut channels 212. In the deployed configuration 292, the strut ring 240 may be moved to the upper position 296 and the plurality of support struts 230 may project upwards and away from a center axis of the center post 210 such that the upper end of the plurality of support struts 230 may engage the seat 250.

The seat 250 may be a horizontal surface adapted for the user 950 to sit upon. The seat 250 may comprise a seat panel 260, the plurality of strut apertures 270, and a plurality of grommets 280. The seat panel 260 may be suspended above the center post 210 by the plurality of support struts 230. In some embodiments, the seat panel 260 may be a flexible fabric panel. As a non-limiting example, the seat panel 260 may be made of canvas. The seat panel 260 may comprise the plurality of strut apertures 270. The plurality of strut apertures 270 may be disposed around the periphery of the seat panel 260. The plurality of support struts 230 may engage the plurality of strut apertures 270 to hold the seat 250 in position. The plurality of strut apertures 270 may be reinforced by the plurality of grommets 280.

In some embodiments, the height of the center post 210 measured from the bottom of the auger 220 to the top of the center post 210 may be between 11.0 inches and 25.0 inches such that the seat 250 is retained as a comfortable height. In some embodiments, the diameter of the center post 210 may be between 1.0 inches and 5.0 inches such that a balance is reached between stability and ease of boring into the sand 902.

In use, the center post 210 may be placed on the sand 902 with the auger 220 down and the center post 210 may be rotated such that the auger 220 bores into the sand 902. The strut ring 240 may be moved to the upper position 296 to place the plurality of support struts 230 in the deployed configuration 292. The top ends of the plurality of support struts 230 may engage the plurality of strut apertures 270 in the seat 250 and the user 950 may sit upon the seat 250. When no longer needed for seating, the seat 250 may be removed from the plurality of support struts 230, the strut ring 240 may be moved to the lower position 294 to place the plurality of support struts 230 in the collapsed configuration 290, and the center post 210 may be rotated in the opposite direction to remove the center post 210 from the sand 902.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used herein, "align" may refer to the placement of two or more components into positions and orientations which either arranges the components along a straight line or within the same plane or which will allow the next step of assembly to proceed. As a non-limiting example, the next step of assembly may be to insert one component into another component, requiring alignment of the components.

As used in this disclosure, an "aperture" may be an opening in a surface. Aperture may be synonymous with hole, slit, crack, gap, slot, or opening.

As used in this disclosure, the "center axis" may be the axis of a cylinder or a prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

As used herein, the words "couple", "couples", "coupled" or "coupling", may refer to connecting, either directly or indirectly, and does not necessarily imply a mechanical connection.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, "flexible" may refer to an object or material which will deform when a force is applied to it, which will not return to its original shape when the deforming force is removed, and which may not retain the deformed shape caused by the deforming force.

As used in this disclosure, a "helix" may be the three dimensional structure that is formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute. "Helical" may be an adjective which indicates that an object is shaped like a helix.

As used in this disclosure, "horizontal" may be a directional term that refers to a direction that is perpendicular to the local force of gravity. Unless specifically noted in this disclosure, the horizontal direction is always perpendicular to the vertical direction.

As used here, the word "midpoint" may refer to a point that is between the ends of an object. An "exact midpoint" may refer to a midpoint that is equidistant from edges of the object in at least one direction. Unless otherwise stated, a midpoint is not required to be at the exact center of the object but instead may be within 50% of the distance from the exact midpoint to the farthest edge, farthest end, or farthest corner.

As used in this disclosure, "orientation" may refer to the positioning and/or angular alignment of a first object relative to a second object or relative to a reference position or reference direction.

As used herein, the word "portable" may refer to a device that may be carried by a single person and may be used at multiple locations. In some cases, portable may imply that the device may be used while being carried.

As used in this disclosure, a "ramp" may be an inclined surface that joins two parallel surfaces that are: 1) of different elevations; or 2) not aligned on the same plane.

As used in this disclosure, "vertical" may refer to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A portable beach stool comprising:

a leg and a seat;

wherein the portable beach stool is adapted for a user to sit upon while at a beach;

wherein an auger at the bottom of the leg is configured to bore into sand such that the leg stands upright in the sand;

wherein the seat detachably couples to a plurality of support struts located on a top half of the leg such that the seat is retained in a horizontal orientation above the leg;

wherein the plurality of support struts collapse when the seat is detached;

wherein the leg comprises a center post, the auger, the plurality of support struts, and a strut ring;

wherein the center post is a vertically-oriented pillar;

wherein the auger comprises a lower end of the center post;

wherein the plurality of support struts are disposed around the center post at a top of the center post;

wherein a plurality of strut channels are vertically-oriented grooves located on the center post;

wherein the bottom of the plurality of strut channels align with a vertical midpoint of the center post;

wherein the plurality of strut channels extend upwards without reaching the top of the center post.

2. The portable beach stool according to claim 1 wherein there is a one-to-one correspondence between the plurality of support struts and the plurality of strut channels.

3. The portable beach stool according to claim 2 wherein one or more ring guide slots are one or more vertically oriented grooves located on the center post;

wherein the one or more ring guide slots guide the vertical movements of the strut ring.

4. The portable beach stool according to claim 3 wherein one or more ring guide tabs located on an inside surface of the strut ring ride in the one or more ring guide slots to prevent the strut ring from twisting.

5. The portable beach stool according to claim 3 wherein the auger comprises a tip and a thread;

wherein the tip is a pointed bottom of the center post;

wherein the thread is a helical ramp that converts rotational motion of the center post into vertical movement of the center post.

6. The portable beach stool according to claim 5 wherein the plurality of support struts are armatures that detachably couple the seat to the center post;

wherein a bottom of the plurality of support struts are hingedly coupled to the inside surface of the strut ring;

wherein a top of the plurality of support struts detachably couple to the seat via a plurality of strut apertures;

wherein the top of the plurality of support struts are shaped to retain the seat at the height of the top of the plurality of support struts.

7. The portable beach stool according to claim 6 wherein the strut ring encircles the center post such that the strut ring slides vertically on the center post between a lower position and an upper position;

wherein in the lower position, the strut ring pulls the plurality of support struts down and pulls the plurality of support struts into the plurality of strut channels.

8. The portable beach stool according to claim 7 wherein the strut ring locks when in the lower position, the upper position, or both.

9. The portable beach stool according to claim 7 wherein the plurality of support struts are moved between a collapsed configuration and a deployed configuration by raising and lowering the strut ring;

wherein in the collapsed configuration, the strut ring is moved to the lower position and the plurality of support struts are pressed into the plurality of strut channels;

wherein in the deployed configuration, the strut ring is moved to the upper position and the plurality of support struts project upwards and away from a center axis of the center post such that an upper end of the plurality of support struts engage the seat.

10. The portable beach stool according to claim 9 wherein the seat is a horizontal surface adapted for the user to sit upon;

wherein the seat comprises a seat panel, the plurality of strut apertures, and a plurality of grommets.

11. The portable beach stool according to claim 10 wherein the seat panel is suspended above the center post by the plurality of support struts.

12. The portable beach stool according to claim 11 wherein the seat panel is a flexible fabric panel.

13. The portable beach stool according to claim 12 wherein the seat panel is made of canvas.

14. The portable beach stool according to claim 11 wherein the seat panel comprises the plurality of strut apertures;

wherein the plurality of strut apertures are disposed around a periphery of the seat panel;

wherein the plurality of support struts engage the plurality of strut apertures to hold the seat in position.

15. The portable beach stool according to claim 14 wherein the plurality of strut apertures are reinforced by the plurality of grommets.

16. The portable beach stool according to claim 15 wherein the height of the center post measured from the bottom of the auger to the top of the center post is between 11.0 inches and 25.0 inches.

17. The portable beach stool according to claim 15 wherein the diameter of the center post is between 1.0 inches and 5.0 inches.

* * * * *